United States Patent [19]

Milan

[11] 4,114,705

[45] Sep. 19, 1978

[54] ROCK DRILLING TOOL HAVING PULSED JETS

[75] Inventor: Daniel Milan, Grenoble, France

[73] Assignee: Societe B.V.S., Grenoble, France

[21] Appl. No.: 787,264

[22] Filed: Apr. 13, 1977

[30] Foreign Application Priority Data

May 26, 1976 [FR] France ..... 76 15976

[51] Int. Cl.[2] ..... E21B 9/08

[52] U.S. Cl. ..... 175/340; 175/67; 175/317; 175/231

[58] Field of Search ..... 175/65, 56, 317, 231, 175/238, 339, 340, 67, 64

[56] References Cited

U.S. PATENT DOCUMENTS

| | | | |
|---|---|---|---|
| 2,746,721 | 5/1956 | Moore | 175/317 |
| 2,902,258 | 9/1959 | Hildebrandt | 175/56 |
| 3,087,558 | 4/1963 | Dougherty, Jr. | 175/317 X |
| 3,138,213 | 6/1964 | Brandon | 175/56 X |
| 3,163,240 | 12/1964 | Bodine | 175/56 |
| 3,216,514 | 11/1965 | Nelson | 175/56 X |
| 3,251,424 | 5/1966 | Brooks | 175/56 |
| 3,315,755 | 4/1967 | Brooks | 175/56 |
| 3,405,770 | 10/1968 | Galle et al. | 175/56 |
| 3,488,765 | 1/1970 | Anderson | 175/61 |
| 3,645,346 | 2/1972 | Miller et al. | 175/340 X |

*Primary Examiner*—Ernest R. Purser
*Assistant Examiner*—Richard E. Favreau
*Attorney, Agent, or Firm*—Haseltine, Lake & Waters

[57] ABSTRACT

In rock drilling utilizing mechanical destruction of the rock and circulation of drilling fluid for removing debris from the cutting face, the drilling fluid is directed on to the cutting face in the form of two opposed pulsed jets, the cycles of which are 180° out of phase. In order to achieve the phased opposition of the pulsed jets a ball is disposed in the distribution chamber of the drilling fluid and is subjected to a combination of hydraulic and mechanical forces which cause the ball to oscillate between two end positions in which the ball respectively closes off one of two outlet ducts leading to nozzles which direct the drilling fluid towards opposite points on the bottom of the drill hole.

6 Claims, 3 Drawing Figures

ROCK DRILLING TOOL HAVING PULSED JETS

FIELD OF THE INVENTION

The invention relates to improvements in rock drilling utilizing mechanical destruction of the rock and circulation of pressurised mud.

PRIOR ART

In known rock drilling methods, the rock is destroyed by the impact of teeth on rotating cutters with the rock to be drilled through. This mechanical destruction of the rock produces debris which has to be removed as it is formed so that the cutting members on the drilling tool constantly operate on fresh rock so as to achieve a satisfactory speed of tool advance, due account being taken of the weight applied to the tool and of the rotation speed of the cutters.

To remove the debris formed during drilling, the tools usually incorporate vents and calibrated nozzles which direct mud to the hole bottom, this fluid circulation entraining and removing the debris.

The circulation of fluid between the hole bottom and the surface and between the surface and the hole bottom has several basic functions at the level of the tool, namely: equalizing the pressures in the hole and in the rock, cooling the tool, cleaning the cutting members, cleaning the bottom of the hole, and removing the rock debris. For a given load on the tool and a given speed of rotation of the cutters, the speed at which the tool advances depends on the effectiveness of the removal of debris from the tool's vicinity.

To avoid the debris which is taken up by the jets from the nozzles being ground several times by the cutter teeth, which would reduce the output of the latter, the time for which the debris remains in the vicinity of the tool must be reduced, and the hydraulic pressure of the nozzles must be controlled. The speed at which the debris is removed is equal to the difference between the speed at which the mud flows and the speed at which the debris settles, and this can be too low in relation to the required drilling speed; increasing the pressure of the mud jets may cause rock fragments to be held tightly against the bottom of the hole, reducing the output of the tool and, in some cases, resulting in a complete jam preventing advance of the tool.

Various solutions have been put forward with a view to overcoming these disadvantages, the solutions aiming at reducing the adhesion of debris with the walls of the hole, or reducing the extent to which the debris is recycled, or providing more rapid evacuation of the debris. It has been proposed that the nozzles be lowered or inclined relative to the cutting face, that the gap between the walls of the drill hole and the tool be enlarged, or that the flow of mud be sucked upwards using special machines.

Such arrangements have the disadvantage of making the drilling tools more complicated, without being sufficiently effective in cases where the removal of debris is made especially difficult by the specific conditions of high-speed drilling. In particular, when turbodrilling equipment rotating at high speeds is used, the centrifugal force on the debris caused by the rotation of the fluid makes it extremely difficult to clean out the drill hole.

SUMMARY OF THE INVENTION

It is an object of the invention to provide a rock drilling apparatus utilizing mechanical destruction of the rock and circulation of pressurized mud to remove the rock debris from the drilling hole, the apparatus enabling optimum use to be made of the cutters, so that high speeds of advance of the drill can be achieved in both rotary and turbine drilling, due to rapid and effective removal of the rock debris formed during drilling.

It is another object of the invention to provide a rock drilling apparatus causing mechanical destruction of the rock and circulating pressurized drilling fluid to remove rock debris from the drilling hole, the apparatus comprising an improvement including means for directing the drilling fluid on to the bottom of the hole in the form of two pulsed jets, the flow rate in each jet switching instantaneously between zero and a maximum value, the combined flow rate being substantially constant and the jets being directed on to opposed points on the hole bottom to produce opposed flows of mud.

It is a further object of the invention to provide a drilling tool comprising a body, means mounted on the body for mechanically breaking up rock, said body incorporating a distribution chamber in communication with an inlet conduit for drilling fluid and with two outlet ducts, one end of each of said outlet ducts projecting into said distribution chamber, and the other end of each of said outlet ducts being connected to a respective calibrated nozzle which, when the tool is in use, is directed towards the cutting face, said distribution chamber containing a ball which, in the absence of any external force, occupies an equilibrium position in which the projecting ends of said outlet ducts are open, and which is movable between two end positions in each of which it closes off the projecting end of a respective one of said outlet ducts, said ball being arranged to be unstable when said inlet conduit receives drilling fluid at the normal operating pressure and flow rates, said ball being then subjected to a combination of hydraulic and mechanical forces which cause it to oscillate between its said two end positions.

BRIEF DESCRIPTION OF THE DRAWINGS

The invention will be more fully understood from the following description of embodiments thereof, given by way of example only, with reference to the accompanying drawings.

In the drawings.

DETAILED DESCRIPTION

Figure 1:
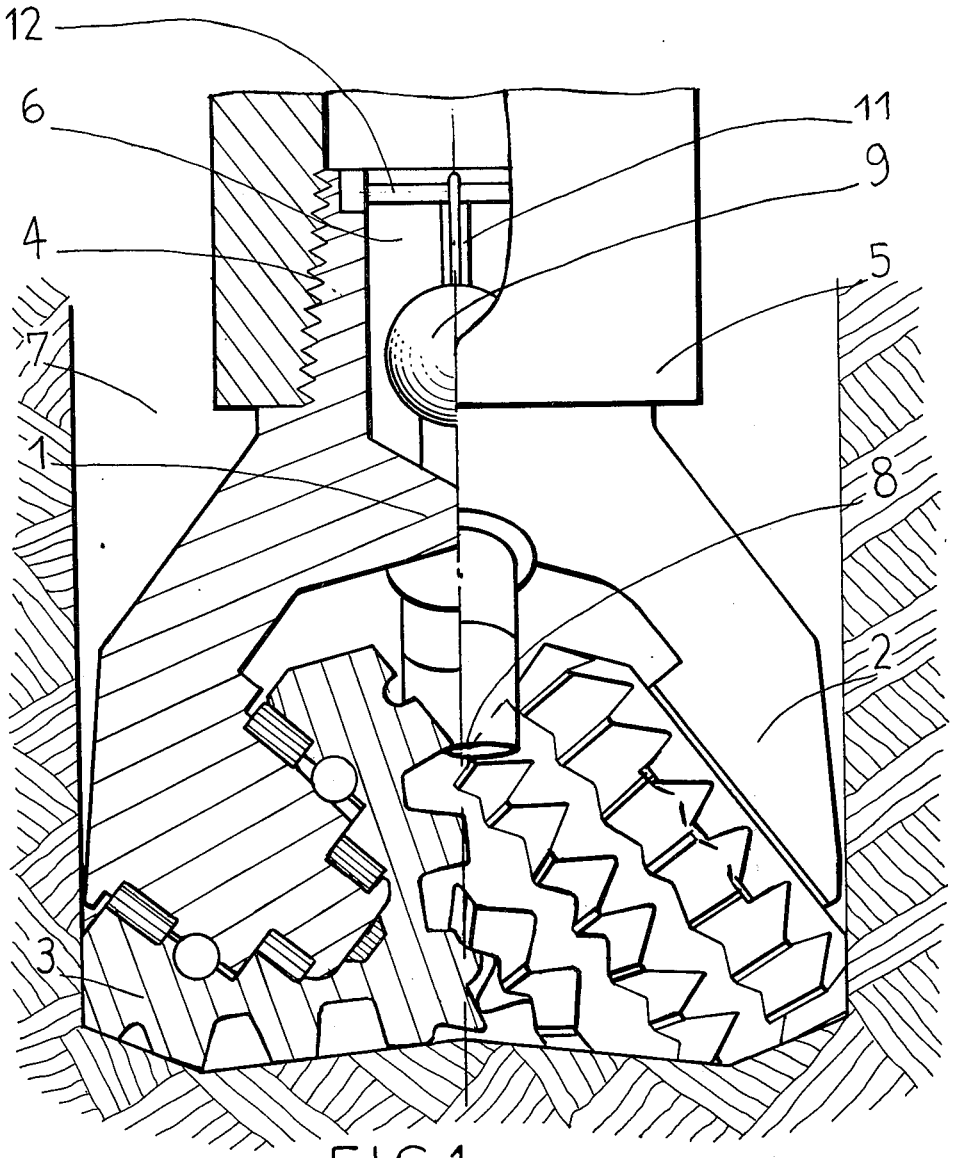
FIG. 1 is a side view of an embodiment of a drilling tool, partially in cross-section in a plane perpendicular to the plane of symmetry of the nozzles.

Referring to FIG. 1, the drilling tool comprises a body 1 having two arms 2, each of which carries a member 3 for breaking up the ground, in the form of a conical cutter. Each of the members 3 has teeth or other cutting elements which are capable of mechanically destroying the ground at the cutting face. The upper portion of the tool body has a threaded portion 4 for attaching it to a tool carrier 5 which rotates the tool. The tool carrier may consist of the drilling pipe, in the case of rotary drilling, or the rotor of the bottom motor, in the case of a tool driven directly by the motor. A chamber 6 is formed in the tool body 1, and communicates with the hollow space inside the drill pipe, through which the pressurized mud flows.

Figure 2:
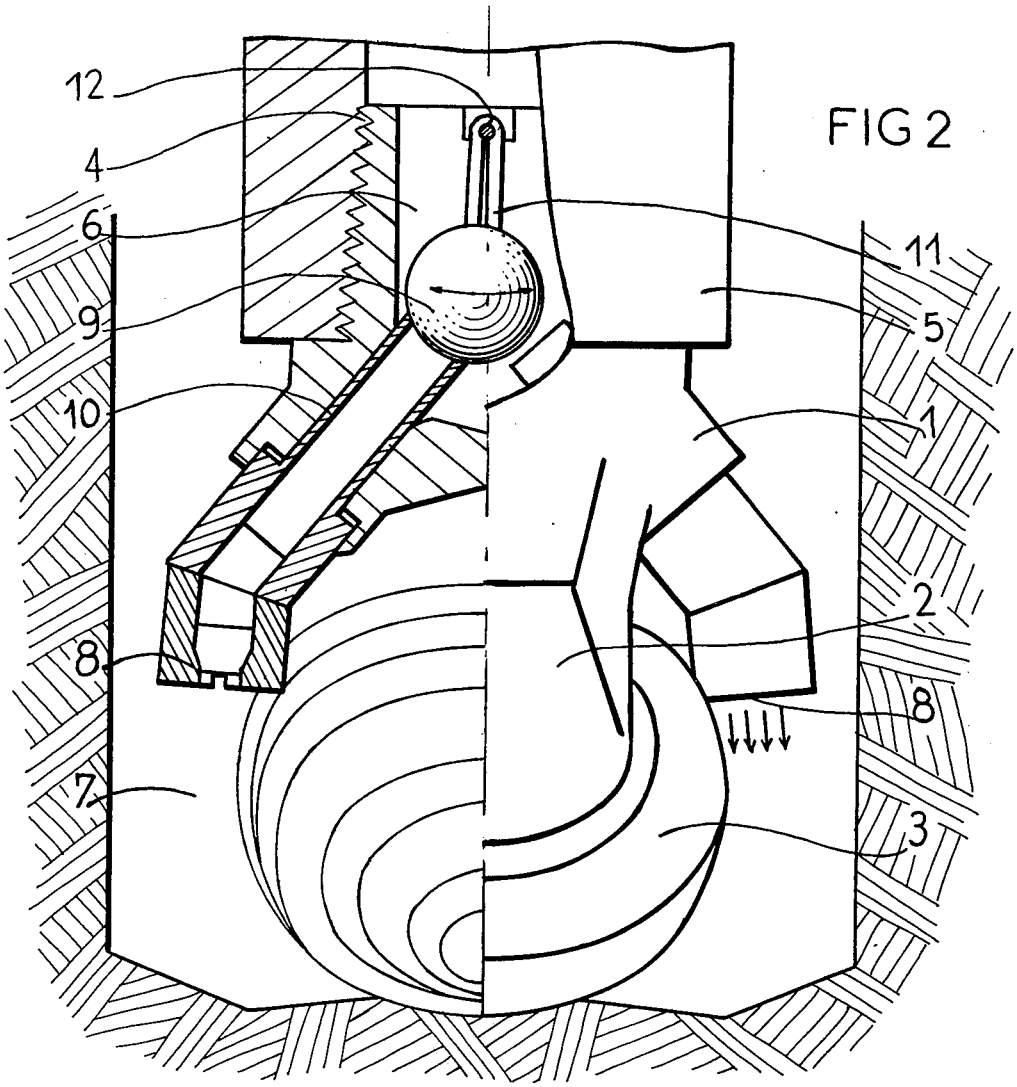
FIG. 2 is a side view of the tool of FIG. 1, partially in cross-section in the plane of the nozzles

The tool body 1 also has two openings communicating with the inside of the drill hole 7, in which are located ducts 10 which can be seen in FIG. 2. The ends of the ducts 10 projecting into the drill hole 7 are strengthened so that calibrated nozzles 8 may be attached to them. The calibrated nozzles 8 are directed towards the bottom of the drill hole 7, and are inclined outwardly, at a small angle to the vertical axis of the tool.

As can be seen in both FIGS. 1 and 2, inside the chamber 6 in the tool body 1 is located a ball 9 connected by a rigid arm 11 to a torsion bar 12 rigidly attached to the tool body and extending perpendicularly to the plane of symmetry of the nozzles 8.

In the absence of any force on the ball, the torsion bar 12 returns it to an equilibrium position on the tool axis equidistant from the inlets of the ducts 10 projecting into the chamber 6.

The operation of the tool during drilling of a drill hole 7 will now be described with reference to FIGS. 1 and 2. The drilling tool is of the biconical type and is attached to the end of the tool carrier, which rotates it; the tool attacks the bottom of the drill hole 7, the cutter teeth breaking off fragments of the solid rock which forms the bottom of the drill hole. Drilling fluid for washing the cutting face is passed into the cavity 6 in the tool body 1 under pressure, through the drill pipe whose lower end, attached to the tool, forms the tool carrier 5. If the ball is kept equidistant from the inlet orifices of the ducts 10, the fluid can pass into both ducts 10, which supply the nozzles 8. The dimensions of the system are so chosen that the various forces on the ball 9 cause it to oscillate between two end positions in each of which it closes off the inlet end of one of the ducts 10, so that the fluid can only escape through the other duct. The forces acting on the ball 9 are the hydraulic forces due to the flow of fluid, the return force of the torsion bar 12, and the centrifugal force due to rotation of the tool. If it is assumed that the rotation speed of the tool and the pressure and flow rate of the drilling fluid injected into the chamber 6 are set by the drilling conditions, the dimensions of the ball 9 and the arm 11 and the rigidity of the torsion bar 12 can be selected to cause the ball to oscillate between its two end positions at a predetermined frequency. The system is therefore designed so that any slight displacement of the ball from its equilibrium position produces a force which tends to increase the initial displacement. Movement of the ball is therefore maintained without the intervention of any force other than those associated with the flow of the drilling fluid and the rotation of the bit.

The movement of the ball 9 cuts off the flow through nozzles 8 alternately, so that two pulsed jets are directed on to the bottom of the drill hole 7. The total flow of fluid through the combination of the two nozzles 8 is substantially constant, whatever the position of the ball. The flow rate through each nozzle and the pressure of the fluid switch instantaneously between zero and maximum values so that maximum flow through one nozzle coincides with zero flow through the other. The injection of mud by means of pulsed jets directing it on to the bottom of the drill hole 7 at diametrically opposite points produces a significant degree of turbulence at the level of the tool, i.e., at the point at which the rock debris is formed, and this enables the debris to be freed from the wall of the drill hole and entrained in the mud flowing to the peripheral part of the drill hole surrounding the drill pipe. The above drilling operation in accordance with the invention has the advantage, over previously known methods, of creating intense turbulence at the point at which the debris is formed, by virtue of the bringing together of two oppositely directed pulsed jets, which greatly increases the speed at which the debris is taken away. The output of the tool is therefore considerably increased.

If the same drive pressure is used in the chamber 6, the average flow rate through both nozzles is hardly altered, as the greatest losses occur in the nozzles when the mud is flowing.

The pulsing device which has just been described also has the advantage that it can be miniaturized very easily and can be incorporated in any kind of tool without difficulty, so that the pulsing can be produced at the level of the tool itself.

Figure 3:
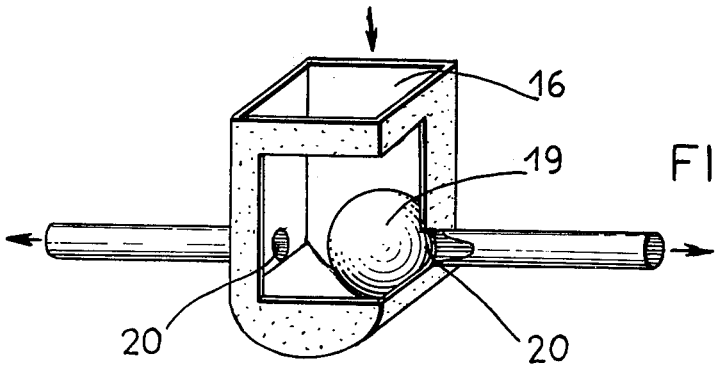
FIG. 3 is a perspective view of a modification of the drilling tool of FIG. 1.

FIG. 3 shows a pulsing device which differs from that shown in the drilling tool described with reference to FIGS. 1 and 2. The chamber 6 in the tool body 1 (FIGS. 1 and 2) is replaced by a closed chamber 16 which has a semi-cylindrical bottom on which a ball rolls. In the end positions of its movement, the ball closes off ducts 20 leading into the chamber 16. The inlets to ducts 20 are oppositely disposed, in opposite walls of the chamber 16. If the pulsing device shown in FIG. 3 is fitted to a drilling tool and drilling fluid is passed into the chamber 16 from above, the ball is subjected to hydraulic forces created by the flow of the fluid between the inlet to chamber 16 and the outlet ducts 20, as well as to its own weight and centrifugal forces due to the rotation of the tool with which the pulsing device is associated.

The system can be designed so that it is unstable, i.e., so that any displacement of the ball from its equilibrium position generates forces which increase the displacement. The ball therefore oscillates between the two closure positions, producing alternating pulsed flows through the nozzles connected to the outlet ends of ducts 20. The corresponding calculations relate the inlet flow rate to the pulsing device, the cross-sections of the ducts 20 and the chamber 16 perpendicular to the flow, the mass of the ball, the radii of the ball and of the semi-cylindrical portion of the chamber 16, and the densities of the drilling fluid and of the material of the ball. For a given inlet flow of drilling fluid, it is therefore possible to determine the dimensions of the cylindrical portion of the chamber and the ball required for the system to be unstable. The various parameters can also be varied to vary the frequency of the pulsing of the jets of liquid escaping from the nozzles connected to the ducts 20. The device shown in FIG. 3 has the advantage that it has no mechanical parts likely to deteriorate in long-term use, and can be made in a very wide range of sizes, depending on the use for which it is intended.

The invention is not, however, intended to be limited to the embodiments which have just been described, and covers all variations thereof, while it is possible to substitute equivalent means without departing from the scope of the invention. Thus, the pulsing device may be fitted to any form of drilling tool, whether of the biconical type, as in the case of the tool which has just been described, or of the tri-conical type which is conventionally used in drilling for oil. If a tri-conical tool of known design is used, the pulsing device is connected into the supply systems of two of the three nozzles associated with the cutters, the third being closed off permanently. It is already known that, when using a tri-conical drilling tool, best results in respect of drilling debris clearance are achieved if only two of the nozzles are used to inject the drilling fluid.

It is also possible to conceive of the use of pulsing devices different from the torsion bar device shown in FIGS. 1 and 2 and the gravity device shown in FIG. 3, the return force on the ball being provided by any suitable mechanical, hydraulic or pneumatic means.

Finally, the drilling operation in accordance with the invention is equally applicable to drilling for oil at great depths, the tool being driven by a drill pipe or by a motor or turbine at the bottom of the drill hole, and to drilling operations in mines and on construction sites.

What is claimed is:

1. A drilling tool for causing mechanical destruction of rock in a drill hole and for circulating pressurized drilling fluid to remove rock debris from the drilling hole, said tool comprising a body, means mounted on the body for mechanically breaking up rock, said body having a distribution chamber in communication with an inlet conduit for drilling fluid and with two outlet ducts, each of said outlet ducts having one end projecting into said distribution chamber and an opposite end, a respective calibrated nozzle connected to each of said opposite ends of said outlet ducts and which, when the tool is in use, is directed towards a cutting face at the bottom of the drill hole, said nozzles being directed towards opposite points on the hole bottom, a ball in said distribution chamber which, in the absence of any external force, occupies an equilibrium position in which said one ends of said outlet ducts are open, and which is movable between two end positions in each of which the ball closes off one end of a respective one of said outlet ducts, said ball being arranged to be unstable when said inlet conduit receives drilling fluid at the normal operating pressure and flow rate, said ball being then subjected to a combination of hydraulic and mechanical forces which causes the ball to oscillate between its said two end positions so that the drilling fluid is directed onto the bottom of the drill hole in the form of two pulsed jets, the rate in each jet varying between zero and a maximum value as the jets produce opposed flows of mud.

2. A drilling tool according to claim 1, wherein said means for mechanically breaking up rock comprises toothed cones which rotate about axes which are inclined with respect to the drilling direction.

3. A drilling tool according to claim 1, comprising means coupling said ball to said body including a rigid arm having one end fixed to said ball and an opposite end, and a torsion bar fixed to said body and extending perpendicularly to the plane of symmetry of said outlet ducts, said opposite end of the rigid arm being connected to said torsion bar.

4. A drilling tool according to claim 3 wherein said rigid arm suspends said ball from said torsion bar.

5. A drilling tool according to claim 1, wherein said distribution chamber has a base constituted at least in part by a cylindrical cup, said cup having an axis extending perpendicular to the plane of symmetry of said outlet ducts, said ball being located in said cup.

6. A drilling tool according to claim 5 wherein said ball is freely rollable in said cup.

* * * * *